United States Patent [19]

Wohlert

[11] 4,207,672

[45] Jun. 17, 1980

[54] HEATER ELEMENT MOUNTING

[75] Inventor: Chester G. Wohlert, Bonita, Calif.

[73] Assignee: Aerospex Corporation, National City, Calif. ; a part interest

[21] Appl. No.: 970,275

[22] Filed: Dec. 18, 1978

[51] Int. Cl.[2] ..... H01C 3/14

[52] U.S. Cl. ..... 29/611; 29/618; 219/542

[58] Field of Search ..... 219/542, 355, 357, 552, 219/463, 465, 467, 468; 338/286, 287, 304, 305, 311; 29/611, 612, 613, 618

[56] References Cited

U.S. PATENT DOCUMENTS

| | | | |
|---|---|---|---|
| 733,610 | 7/1903 | Yates | 338/311 |
| 848,954 | 4/1907 | Barringer | 338/311 |
| 1,490,767 | 4/1924 | Curtis | 219/467 |
| 1,644,255 | 10/1927 | Kercher | 219/465 |
| 1,905,232 | 4/1933 | Kercher | 219/542 |
| 2,091,905 | 8/1937 | Bensel | 219/461 |
| 3,047,702 | 7/1962 | Lefebvre | 219/464 |
| 4,091,355 | 5/1978 | Beck | 219/347 |

*Primary Examiner*—Francis S. Husar
*Assistant Examiner*—Gene P. Crosby
*Attorney, Agent, or Firm*—Frank D. Gilliam

[57] ABSTRACT

A method of mounting heating wire coils on ceramic fiber insulation walls. A ceramic fiber cement bead is applied in a desired pattern to the surface of a ceramic fiber wall, either directly to a flat surface or in a groove. An elongated iron-chromium-aluminum alloy heater wire coil is pressed into said cement so that the cement flows up and over the coil loops which contact the wall and the cement is cured. Because of the non-scaling (adherent $Al_2O_3$ skin) characteristics of this heater wire alloy, the cement adheres tenaciously to the wire even under severe thermal shock and temperature cycling.

4 Claims, 5 Drawing Figures

HEATER ELEMENT MOUNTING

BACKGROUND OF THE INVENTION

This invention relates in general to mounting heating elements on insulating materials and, more specifically, to mounting iron-chromium-aluminum alloy heater wire coils on ceramic fiber insulation walls.

Small furnaces, kilns, etc., have long been heated by electrical heating coils mounted on the interior of firebrick housings. While these kilns are initially inexpensive, the relatively inefficient insulation characteristics of firebrick have resulted in high energy costs, long cycling times and large, heavy kilns.

Some years ago, ceramic fiber insulation materials were developed. These ceramic fiber materials have one-fourth the weight and twice the insulating capability of firebrick. Initially expensive, the cost of ceramic fiber insulation has dropped due to improved manufacturing techniques, economics of higher volume production, etc.

As the cost of energy has increased, the ceramic fiber insulation materials have come into increasing use in small kilns, furnaces and the like. Problems have been encountered in mounting heating elements on the interior walls of such kilns. The method generally used is to form the fiber insulation entirely around and over the wire helix or coil used as the heating element. This total embedding is ordinarily accomplished during the vacuum forming of the ceramic fiber wall itself. To embed the heating coil less than 100% was found to produce a weak bond with the heater wires tending to work loose and crack the insulation.

While this full embediment method effectively held the heater wires in place, a number of problems remained. Because of the temperature gradient across the insulating material between the coil and the inner surface of the kiln, necessary to provide the desired interior temperature in the kiln, the heating elements often need to be as much as 400° F. above the temperature of coils in open construction. These high temperatures greatly shorten heating element life. Of course, the inner insulation wall surrounding the coil is also overheated by a similar amount, which causes devitrification and shrinkage of the fibers with resultant severe warping and cracking of the insulation, thus reducing wall insulating properties. Also, since the volume of insulating material surrounding the heating coil must act as part of the heater, the overall thickness of insulating material must be increased to prevent the kiln exterior surfaces from reaching dangerously high temperatures.

Attempts have been made to anchor the bottom of each loop of the wire helix in a dense alumina bar, then embed the bar in a slot in the fiber wall. While this allows the exposed portion of the coil to radiate freely, this system is complex and costly to manufacture. Problems remain in obtaining secure bonding between the alumina bar and ceramic fiber wall and in retaining good bonding between heater coil and alumina during prolonged thermal cycling.

Thus, there is a continuing need for improved methods of mounting heater wire coils on ceramic fiber insulation walls.

SUMMARY OF THE INVENTION

The above-noted problems, and others, are overcome by the mounting method of this invention. In this method, a bead of ceramic fiber cement is applied in a selected pattern to the surface of a ceramic fiber insulation wall. The cement may be applied to a planar surface or may at least partially fill a groove in the wall. An elongated heater coil formed from a wire comprising iron, chromium and aluminum is pressed against the cement so that the cement flows up and over the bottom of each loop of the wire helix. The cement is then cured, such as by air drying.

The iron-chromium-aluminum heater coil alloy, as described below, has been found to provide an excellent bond to the cement, which bond remains intact throughout prolonged thermal cycling and exposure to high temperatures. The cement has also been found to penetrate into interstices in the fiber insulation, producing a strong bond to the wall and strengthening the fiber wall adjacent to the heating element.

BRIEF DESCRIPTION OF THE DRAWING

Details of the invention, and of preferred embodiments thereof, will be further understood upon reference to the drawing, wherein.

DETAILED DESCRIPTION OF THE INVENTION

Figure 1:
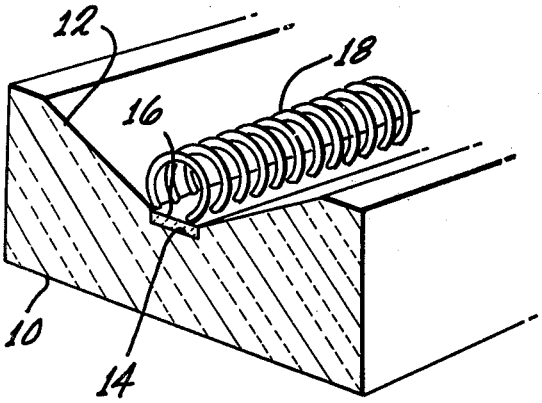
FIG. 1 is a perspective view, partially in section, illustrating a coil mounted by the method of this invention.

Referring now to FIG. 1, there is seen a ceramic fiber insulation wall 10, which may typically be the wall of a conventional kiln or furnace. On the upper (or hot interior) surface of wall 10 there is seen a shallow, wide, groove 12 having a further narrow groove 14 at the center thereof. Groove 14 is filled with a ceramic fiber cement 16.

Ceramic fiber cement 16 may comprise any suitable cement. Basically, these cements may be characterized as mixtures of short aluminum silicate fibers in an aqueous dispersion of a colloidal inorganic oxide, such as colloidal silica. Typical cements of this type are disclosed in U.S. Pat. No. 3,231,401. Typical commercially available cements of this type include "QF-180" available from the Carborundum Co., Kaowool Ceramic Fiber Cement available from Babcock & Wilcox, and Cera-kote available from Johns-Monville. Groove 14 may have a bead of cement 16 applied thereto by any suitable means, such as an extrusion nozzle or other pouring means.

An elongated heater coil 18 is pressed into groove 14 with the bottom of each coil loop brought into substantial contact with the floor of the groove and covered by cement 14.

While the layer of cement 14 may have any suitable thickness, it is important that the cement entirely cover the bottom of each loop of coil 18, as shown in FIG. 1. Preferrably, the cement layer will be from about ten to forty per cent of the coil diameter, remembering that the minimum thickness should exceed the heater wire diameter by at least about fifty per cent.

Elongated heater coil 18 may have any suitable configuration, including any suitable wire diameter, coil diameter, coil loop spacing, etc.

Coil 18 is fabricated from an alloy comprising iron, chromium and aluminum such as Hoskins 875, available from the Hoskins Manufacturing Co., Detroit, Michigan; Kanthal A1, A, D and DS available from the Kanthal Corp., Tethel, Conn.; Alchrome D and 750 available from W B Driver Co., Newark, New Jersey. Basically, these alloys are primarily iron, with smaller percentages of chromium and aluminum and often, include small amounts of cobalt or other elements. Preferrably, the alloy has from about 4 to 6 wt % aluminum, about 22 wt % chromium and about 0.5 wt % cobalt. The balance of the alloy is iron. These heater coil alloys have been found to have outstanding adhesion to the cements described above, apparently due to their non-scaling characteristics and physical properties. The heater coil to cement bond has been found to remain effective up to the melting temperature of the alloy.

Figure 2:
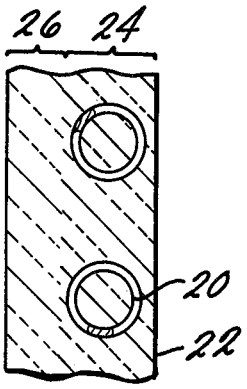
FIG. 2 PRIOR ART
FIG. 2 is a vertical section, perpendicular to an insulating surface, showing the Prior Art method of coil mounting.

FIG. 2 illustrates the prior art method of mounting a heating element on ceramic fiber insulation material. The heater coil 20 is fully embedded in wall 22, such as by placing the coil of a partially formed wall, then continuing vacuum deposition of the ceramic fiber to the full thickness. With this arrangement, the entire thickness 24 (indicated by heavier hatching) is heated by coil 22 and transmits heat by conduction to the inside surface of the furnace chamber where it is radiated into the furnace chamber. Only the outer wall thickness 26 (indicated by lighter hatching) fully functions as insulation. Clearly, this arrangement requires much thicker insulation to provide required insulating characteristics and prevent high temperatures at the outer kiln wall surface.

Figure 3:
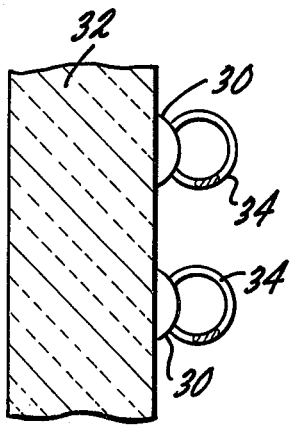
FIGS. 3, 4 and 5 are vertical sectional views taken on lines perpendicular to insulating surfaces, illustrating three alternative embodiments of the coil mounting means and method of this invention.
Figure 4:
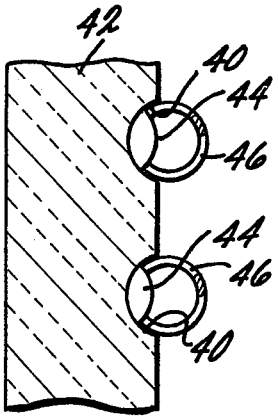
Figure 5:
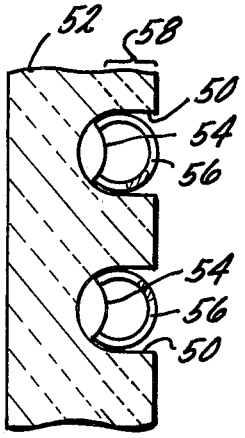

FIGS. 3, 4 and 5 schematically illustrate three alternative embodiments in positioning the heater coil by the method of this invention.

In FIG. 3, beads of cement 30 are applied in a desired pattern to the planar inner surface of ceramic fiber insulating wall 32. The coil 34 is then pressed against the cement to cause the cement to flow up and over the bottoms of each coil loop. Coil 34 can be held in place by the cement itself, if sufficiently tacky, or may be pressed thereagainst by a tool (not shown) having a surface groove corresponding to the cement bead pattern, with the groove serving to locate the coil in the proper position. This embodiment has the advantage of a flat insulation surface, requiring no machining or routing of the insulation wall surface. This embodiment does, however, ordinarily require an aligning tool to position and hold coil 34 in place during cement hardening.

FIG. 4 schematically illustrates an embodiment in which a shallow groove 40 is formed (such as by conventional routing) in the inner surface of insulation wall 42, a bead of cement 44 is laid in groove 40 and heater coil 46 is pressed into groove 40, allowing cement 44 to flow up and over the portion of each loop of coil 46 in the groove. Coil 46 may be held in place by the cement, if tacky, or may be pressed into place by a flat tool (not shown) during cement curing. This embodiment has the advantages of precise coil positioning in precision, factory-produced, grooves and shares with the embodiment of FIG. 3 the exposure of most of the coil to the furnace interior for rapid radiant heating. Of course, forming grooves 40 adds to the manufacturing costs.

FIG. 5 schematically illustrates an embodiment having deep grooves 50 in the inner surface of insulating wall 52. A bead of cement 54 is applied to each groove 50, then heating coil 56 is pressed thereinto so that cement 54 flows up and over the innermost portion of each loop of coil 56. The coil can be retained by tacky cement during curing, or may be pressed into groove 50 by a flat tool (not shown). This embodiment has advantages of retaining the coil in position despite minor cement failures, and shares the pecise coil locating capabilities of the embodiment of FIG. 4. However, the deep grooves are relatively expensive to machine and the deep set coil tends to heat the adjacent insulating material, since less direct exposure to the kiln interior is provided. The heated portions of insulating wall 52 are indicated by heavy hatching in areas 58.

In most cases, the embodiment shown in FIG. 4 (or the variation shown in FIG. 1) is preferred for the best combination of precise coil positioning, ease of manufacture and effective heating by the coil. This arrangement also permits the entire insulation wall to act as thermal insulation. Optimum results have been obtained with groove depths equal to about 15 to 30 percent of the coil outer diameter. These depths provide an optimum combination of coil positioning, cement retention and coil exposure for free heat radiation. In certain specific circumstances the embodiments shown in FIGS. 3 and 5 may be preferred.

The following examples further illustrate preferred examples of the method of this invention.

EXAMPLE I

A small kiln is lined with 1.5 inch thick Fiberfrax ceramic fiber insulation, available from Carborundum Co. A shallow groove having a depth of about 0.125 inch is formed in a "zig-zag" pattern in the inner surface of the insulation and thin bead of QF 180 cement, a ceramic fiber cement available from the Carborundum Co., is applied to the grooves. An elongated coil of Kanthal A-1 heater wire, an iron-chromium-aluminum heater wire available from Kanthal Corp., having an outer coil diameter of 0.25 inch is held in the groove while the cement is air dried. The cement covers the bottom portions of the coil loops. The furnace is assembled, turned on and is cycled between 200° and 2200° F., three times an hour for eight weeks. A fan is used to speed cooling cycles. After 4035 cycles, the furnace is taken apart and examined. Warping of the ceramic fiber walls is found to be negligible. The temperature reached on the exterior of the walls is found to be much lower than reached during similar cycling tests with coils embedded in walls of similar thickness (as illustrated in FIG. 2). The heater coil mounting method of this example is found to produce improved thermal shock resistance and improved life, with no significant deterioration of the coil/cement bond.

EXAMPLE II

A furnace is lined with 2 inch thick Kaowool ceramic fiber insulation from Babcock & Wilcox. A groove having a depth of about 0.25 inch is routed in a continuous pattern in the inner (or hot) insulation surface. A thin bead of Kaowool Fiber Cement, from Babcock & Wilcox is applied to the groove. An elongated coil of Hoskins 875 heater wire, an iron-chromium-aluminum heater wire from the Hoskins Manufacturing Co., having a coil diameter of about 0.32 inch is pressed into the groove and held in place while the cement is air dried. The cement covers the bottom loops of the coil and has a thickness equal to about 20% of the coil diameter. The furnace is turned on and cycled through a number of heat and cool cycles, reaching maximum temperatures of about 2000° F. The heater coil is found to remain well bonded to the insulation, with no deterioration of the cement bond.

EXAMPLE III

A furnace is lined with 1.75 inch thick Cerafelt ceramic fiber insulation from Johns-Manville. A groove having a depth of about 0.32 inch is formed in a continuous pattern in the inner insulation surface. A thin bead of Cera-kote fiber cement from Johns-Manville is applied to the groove. An elongated 0.375 inch diameter coil of Kanthal DS heater wire, an iron-chromium-aluminum heater wire from the Kanthal Co. is pressed into the groove and held in place while the cement is air dried. The cement covers the bottom loops of the coil and has a thickness equal to about 25% of the coil diameter. The furnace is operated in continuous heat/cool cycles for several days, reaching maximum temperatures of about 2200° F. The bond between the coil and cement is found to be unaffected.

The above examples and illustrations describe certain specific materials, proportions and dimensions in describing preferred embodiments of the invention. These may be varied where suitable with similar results.

Other variations, ramifications and applications of the present invention will occur to those skilled in the art upon reading this disclosure. These are intended to be included within the scope of this invention as defined in the appended claims.

What is claimed is:

1. The method of mounting heating coils on ceramic fiber insulation for electrically heated devices which comprises the steps of:
   - providing an iron-chromium alloy heater wire in elongated coil form;
   - providing a ceramic fiber insulation wall to which said heater wire coil is to be secured in a selected pattern;
   - applying a bead of a ceramic fiber cement to said wall in said selected pattern; said cement comprising aluminum silicate fibers in an aqueous dispersion of a colloidal inorganic oxide;
   - allowing a portion of the cement to penetrate the interstices of the fiber insulation wall surface;
   - pressing said heater wire coil against said cement following said pattern so that said cement flows up and over the bottom of each coil loop in contact with said wall; and
   - curing said cement whereby said heater wire coil is securely bonded to said ceramic fiber insulation wall.

2. The method according to claim 1 wherein said cement is applied in sufficient thickness to cover from about 10 to 40 percent of the diameter of said coil.

3. The method according to claim 1 including the further step of forming grooves in said wall in said selected pattern prior to applying said cement and applying said cement to at least partially fill said groove.

4. The method according to claim 3 wherein said groove is formed to a depth equal to from about 10 to 90 percent of the outer diameter of said coil.

* * * * *